US010455919B2

(12) United States Patent
Saito

(10) Patent No.: US 10,455,919 B2
(45) Date of Patent: Oct. 29, 2019

(54) PEN AND PEN REFILL HAVING A LONGITUDINALLY EXTENDING GROOVE FOR TRANSFERRING DECORATIVE PARTICLES

(71) Applicant: Kuretake Co., Ltd., Nara (JP)

(72) Inventor: Natsumi Saito, Nara (JP)

(73) Assignee: Kuretake Co., Ltd., Nara (JP)

( * ) Notice: Subject to any disclaimer, the term of this patent is extended or adjusted under 35 U.S.C. 154(b) by 190 days.

(21) Appl. No.: 15/518,315

(22) PCT Filed: Oct. 14, 2015

(86) PCT No.: PCT/JP2015/079096
§ 371 (c)(1),
(2) Date: Apr. 11, 2017

(87) PCT Pub. No.: WO2016/060186
PCT Pub. Date: Apr. 21, 2016

(65) Prior Publication Data

US 2017/0311696 A1 Nov. 2, 2017

(30) Foreign Application Priority Data

Oct. 16, 2014 (JP) ..... 2014-212003

(51) Int. Cl.

| | |
|---|---|
| ***B43K 8/02*** | (2006.01) |
| ***B43K 8/03*** | (2006.01) |
| ***B43K 8/06*** | (2006.01) |
| ***B43K 8/12*** | (2006.01) |
| ***B43K 1/00*** | (2006.01) |

(Continued)

(52) U.S. Cl.
CPC ..... *A45D 34/042* (2013.01); *A45D 34/04* (2013.01); *B43K 1/003* (2013.01); *B43K 1/006* (2013.01); *B43K 3/00* (2013.01); *B43K 5/14* (2013.01); *B43K 8/022* (2013.01); *B43K 8/026* (2013.01);

(Continued)

(58) Field of Classification Search
CPC ..... B43K 1/00; B43K 1/003; B43K 1/006; B43K 1/01; B43K 1/06; B43K 1/12; B43K 5/02; B43K 5/18; B43K 5/1809; B43K 8/02; B43K 8/022; B43K 8/024; B43K 8/026; B43K 8/03; B43K 8/04; B43K 8/06; B43K 8/12; B43K 5/14; B43K 3/00;

(Continued)

(56) References Cited

U.S. PATENT DOCUMENTS 2,431,015 A 11/1947 Andrews et al.
3,507,600 A 4/1970 Cress (Continued)

FOREIGN PATENT DOCUMENTS

CN 1240387 A 1/2000
CN 1882440 A 12/2006

(Continued)

*Primary Examiner* — Patrick M. Buechner
(74) *Attorney, Agent, or Firm* — The Webb Law Firm

(57) ABSTRACT

A pen has an ink reservoir configured to store an ink containing decorative particles and a pen tip configured to apply the ink to an ink coating target. The pen tip includes a proximal end to which the ink is supplied from the ink reservoir, a distal end opposite to the proximal end and configured to contact the ink coating target, and a groove opening on the outer circumferential surface of the pen tip and extending from the proximal end to the distal end.

16 Claims, 15 Drawing Sheets

(51) Int. Cl.
*B43K 3/00* (2006.01)
*A45D 34/04* (2006.01)
*B43K 5/14* (2006.01)

(52) U.S. Cl.
CPC ..... *B43K 8/03* (2013.01); *B43K 8/06* (2013.01); *B43K 8/12* (2013.01)

(58) Field of Classification Search
CPC .... A45D 34/042; A45D 34/04; A45D 40/261; A45D 40/262
See application file for complete search history.

(56) References Cited

U.S. PATENT DOCUMENTS 3,518,019 A * 6/1970 Nakamura ..... B43K 1/003 15/446
3,586,454 A * 6/1971 Funahashi ..... B43K 1/003 138/114
3,614,248 A 10/1971 Otsuka
3,627,868 A * 12/1971 Funahashi ..... B43K 1/003 264/171.13
4,229,115 A * 10/1980 Olinsky ..... B43K 1/006 401/196
4,382,707 A 5/1983 Anderka
4,671,692 A 6/1987 Inaba
5,096,322 A * 3/1992 Shiga ..... B43K 1/003 401/199
5,775,828 A 7/1998 Ikeda
5,906,446 A 5/1999 McCulloch et al.
6,474,893 B1 * 11/2002 Osada ..... B43K 1/00 401/196
7,364,614 B2 4/2008 Kwan et al.
7,981,210 B2 7/2011 Kwan et al.
8,128,304 B2 3/2012 Kurita et al.
8,617,646 B2 12/2013 Sexton
9,050,850 B2 6/2015 Gillum et al.
9,096,769 B2 8/2015 Sexton
2003/0143017 A1 * 7/2003 Osada ..... B43K 1/00 401/199
2005/0095055 A1 5/2005 Kwan et al.
2006/0127163 A1 6/2006 Rahn et al.
2007/0212159 A1 9/2007 Kurita et al.
2009/0025602 A1 1/2009 Kwan et al.
2011/0274478 A1 * 11/2011 Yamanaka ..... B43K 1/00 401/223
2013/0170887 A1 7/2013 Gillum et al.
2013/0171345 A1 7/2013 Sexton
2014/0072719 A1 3/2014 Sexton
2016/0243879 A1 * 8/2016 Chan ..... B43K 1/00

FOREIGN PATENT DOCUMENTS

CN 1942328 A 4/2007
CN 101032905 A 9/2007
CN 104010827 A 8/2014
CN 104011150 A 8/2014
GB 1221173 A 2/1971
GB 1405383 A 9/1975
JP 57129680 U 8/1982
JP 607191 Y2 3/1985
JP 61112985 U 7/1986
JP 200325783 A 1/2003
JP 2005342950 A 12/2005
JP 2010148758 A 7/2010
JP 2010269133 A 12/2010
JP 2012-101395 A * 5/2012
JP 2012135982 A 7/2012

* cited by examiner

PEN AND PEN REFILL HAVING A LONGITUDINALLY EXTENDING GROOVE FOR TRANSFERRING DECORATIVE PARTICLES

CROSS-REFERENCE TO RELATED APPLICATIONS

This application is the United States national phase of International Application No. PCT/JP2015/079096 filed Oct. 14, 2015, and claims priority to Japanese Patent Application No. 2014-212003 filed Oct. 16, 2014, the disclosures of which are hereby incorporated in their entirety by reference.

FIELD

The present invention relates to a pen and a pen refill used as a writing tool or a makeup kit.

BACKGROUND

Conventionally, there have been various types of writing tools and makeup kits, and as an example thereof, a pen configured to be capable of applying an ink containing reflective or glossy decorative particles (so-called lame ink) to an object or the like is provided.

The pen of this type includes an ink reservoir configured to store the ink containing decorative particles, and a pen tip to which the ink is supplied from the ink reservoir and which is configured to apply the supplied ink to an ink coating target.

The ink reservoir has a circumferential wall that defines an internal space containing the ink. There are various ink reservoirs, and examples thereof include an ink reservoir with an internal space filled with a liquid ink (see Patent Literature 1, for example), an ink reservoir with an internal space entirely filled with an ink absorbing member which has liquid absorbability and has absorbed an ink (see Patent Literature 2, for example), and an ink reservoir with a specific region of an internal space filled with a liquid ink and with the remaining region of the internal space filled with an ink absorbing member which has liquid absorbability and has absorbed an ink (see Patent Literature 3, for example).

Examples of the pen tip include a pen tip formed by bundling a large number of hair strands and a pen tip formed by molding a fiber material into a rod shape. The pen tip has a proximal end connected to an ink guide and a distal end located opposite to the proximal end and configured to contact a coating target. The pen tip is configured to allow the ink from the ink guide to adhere thereon from the proximal end to the distal end by capillary force of the microspaces between the hair strands or fibers.

The pen of this type is configured so that, when the distal end of the pen tip contacts an ink coating target, the ink on the pen tip is transferred to the coating target, and the ink on the pen tip is consumed. Then, the ink is supplied from the ink reservoir to the pen tip by capillary force of the pen tip.

Thus, the pen of this type is configured to be capable of continuously applying the ink to the ink coating target.

CITATION LIST

Patent Literature

Patent Literature 1: Japanese Examined Utility Model Application Publication No. S60-7191 Y
Patent Literature 2: JP 2005-342950 A
Patent Literature 3: JP 2012-135982 A

SUMMARY

Technical Problem

By the way, when the pen of this type is repeatedly used, the decorative particles contained in the ink may deposit in microspaces (between the hair strands or fibers) inside the pen tip, thereby disabling the supply of the ink to the pen tip, in some cases.

Specifically, the pen tip of the pen of this type is formed by bundling a large number of hair strands or molding a fiber material into a rod shape, and therefore the microspaces surrounded by the hair strands or the fibers serve as the circulation path of the ink. Therefore, the repeated use thereof increases the chance for the decorative particles contained in the ink to be caught by or adhere to the hair strands, fibers, or the like, which are present in the periphery of the microspaces as the circulation path of the ink. As a result, clogging may occur in the microspaces (microspaces which should exert capillary force originally) as the circulation path of the ink, resulting in a failure to supply an appropriate amount of ink to the distal end of the pen tip in some cases. Accordingly, there may be cases where the use of the pen of this type cannot be smoothly started.

It is therefore an object of the present invention to provide a pen and a pen refill capable of appropriately supplying an ink containing decorative particles to a pen tip and smoothly starting the use thereof.

Solution to Problem

A pen according to the present invention includes: an ink reservoir configured to store an ink containing decorative particles; and a pen tip configured to apply the ink to an ink coating target, wherein the pen tip includes: a proximal end to which the ink is supplied from the ink reservoir; a distal end opposite to the proximal end and configured to contact the ink coating target; and a groove opening on the outer circumferential surface of the pen tip and extending from the proximal end to the distal end.

As an aspect of the pen according to the present invention, it is preferable that a plurality of grooves of the pen tip as described above be provided at intervals in the circumferential direction around the outer circumference of the pen tip.

As another aspect of the pen according to the present invention, it is preferable that the groove of the pen tip be enlarged from the center side toward the outer circumference of the pen tip.

As still another aspect of the pen according to the present invention, the configuration may further include an ink guide configured to guide the ink in the ink reservoir toward the pen tip, wherein the ink guide includes: one end connected to the ink reservoir; the other end opposite to the one end and connected to the pen tip; and a groove opening on the outer circumferential surface of the ink guide and extending from the one end to the other end.

In this case, it is preferable that a plurality of grooves of the ink guide as described above be provided at intervals in the circumferential direction around the outer circumference of the ink guide.

Further, it is preferable that the groove of the ink guide be enlarged from the center side toward the outer circumference of the ink guide.

In this case, it is preferable that the pen tip and the ink guide be molded integrally and continuously with each other, and the groove of the pen tip and the groove of the ink guide be formed continuously with each other.

A pen refill according to the present invention includes an ink reservoir configured to store an ink containing decorative particles, the ink reservoir being housed in a barrel shaft constituting the exterior of a pen; and a pen tip configured to apply the ink to an ink coating target and configured to apply the ink to the ink coating target by being exposed from the barrel shaft, wherein the pen tip includes: a proximal end to which the ink is supplied from the ink reservoir; a distal end opposite to the proximal end and configured to contact the ink coating target; and a groove opening on the outer circumferential surface of the pen tip and extending from the proximal end to the distal end.

As an aspect of the pen refill according to the present invention, it is preferable that a plurality of grooves of the pen tip as described above be provided at intervals in the circumferential direction around the outer circumference of the pen tip.

As another aspect of the pen refill according to the present invention, it is preferable that the groove of the pen tip be enlarged from the center side toward the outer circumference of the pen tip.

As another aspect of the pen refill according to the present invention, the configuration may further include an ink guide configured to guide the ink in the ink reservoir toward the pen tip, wherein the ink guide includes: one end connected to the ink reservoir; the other end opposite to the one end and connected to the pen tip; and a groove opening on the outer circumferential surface of the ink guide and extending from the one end to the other end.

In this case, it is preferable that a plurality of grooves of the ink guide as described above be provided at intervals in the circumferential direction around the outer circumference of the ink guide.

Further, it is preferable that the groove of the ink guide be enlarged from the center side toward the outer circumference of the ink guide.

In this case, it is preferable that the pen tip and the ink guide be molded integrally and continuously with each other, and the groove of the pen tip and the groove of the ink guide be formed continuously with each other.

DESCRIPTION OF EMBODIMENTS

Hereinafter, an embodiment of the present invention will be described with reference to the attached drawings. While the pen according to the present invention is used as a writing tool or a makeup kit, a makeup kit (nail art pen) will be described as an example in this embodiment.

Figure 1:
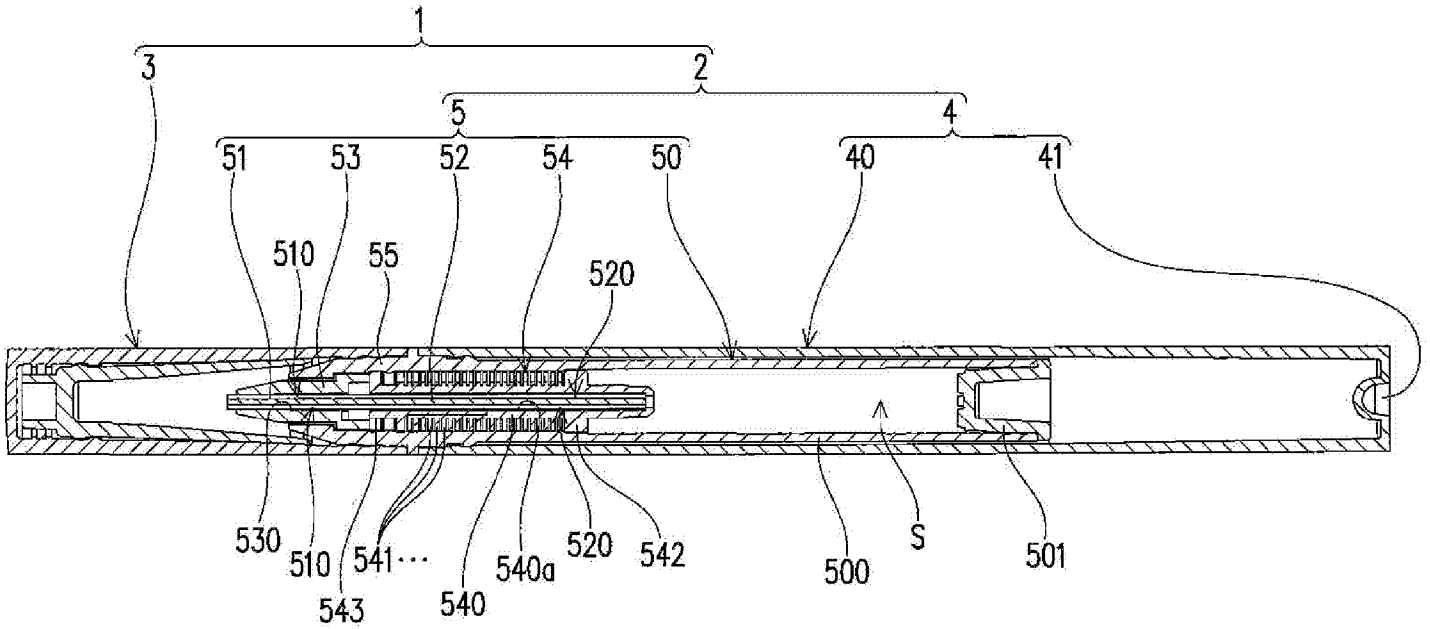
FIG. 1 is a sectional view of a pen according to an embodiment of the present invention.
Figure 2:
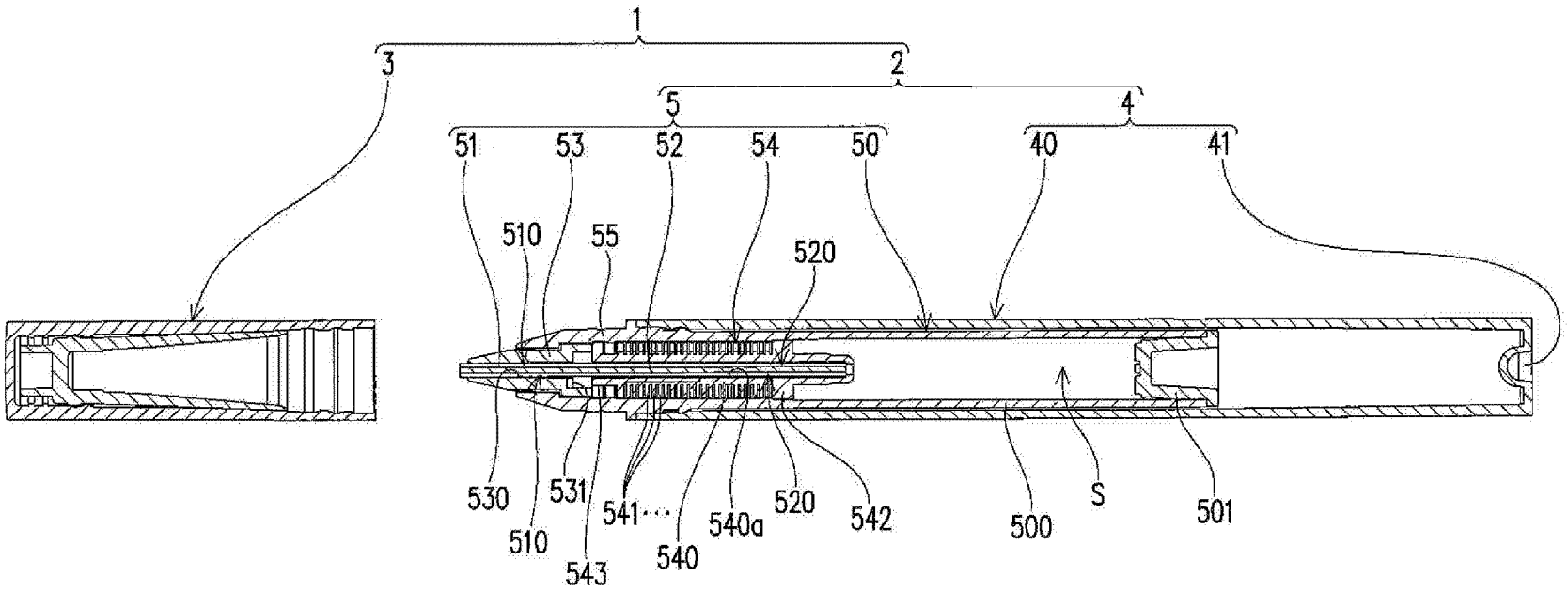
FIG. 2 is a sectional view of the pen according to the aforementioned embodiment when a cap is detached from a pen body.

As shown in FIG. 1 and FIG. 2, a pen according to this embodiment includes a pen body 2 having a pen tip 51 configured to apply a lame ink (lame ink for nail art in this embodiment) to an ink coating target (nail art target in this embodiment), and a cap 3 configured to cover the pen tip 51 of the pen body 2. The "lame ink" herein means an ink containing decorative particles obtained by refining a reflective or glossy material such as a mineral, a metal, or a fiber into powder form, granular form, or flake form.

The pen body 2 includes an exterior body 4 constituting the exterior, and a pen refill (hereinafter, simply referred to as refill) 5 provided inside the exterior body 4.

The exterior body 4 includes a cylindrical barrel shaft 40 having one end and the other end opposite to the one end, and a tail 41 closing the one end of the barrel shaft 40.

The refill 5 includes an ink reservoir 50 configured to store the ink containing decorative particles, and the pen tip 51 having a proximal end and a distal end opposite to the proximal end, the pen tip 51 being configured to apply the ink to the ink coating target. In this embodiment, the refill 5 includes an ink guide 52 configured to guide the ink in the ink reservoir 50 toward the pen tip 51. Further, the refill 5 includes a holder part 53 having a through hole 530 through which the pen tip 51 is inserted, the holder part 53 being configured to hold the pen tip 51 while exposing the distal end of the pen tip 51 in the state where the pen tip 51 is inserted through the through hole 530.

The ink reservoir 50 has a circumferential wall 500 that defines an internal space S containing the ink. More specifically, the ink reservoir 50 of this embodiment includes the cylindrical circumferential wall 500 having one end and the other end opposite to the one end, and a closure part 501 that closes the one end of circumferential wall 500. Thus, the ink reservoir 50 has the internal space S closed by the circumferential wall 500 and the closure part 501.

Figure 3:
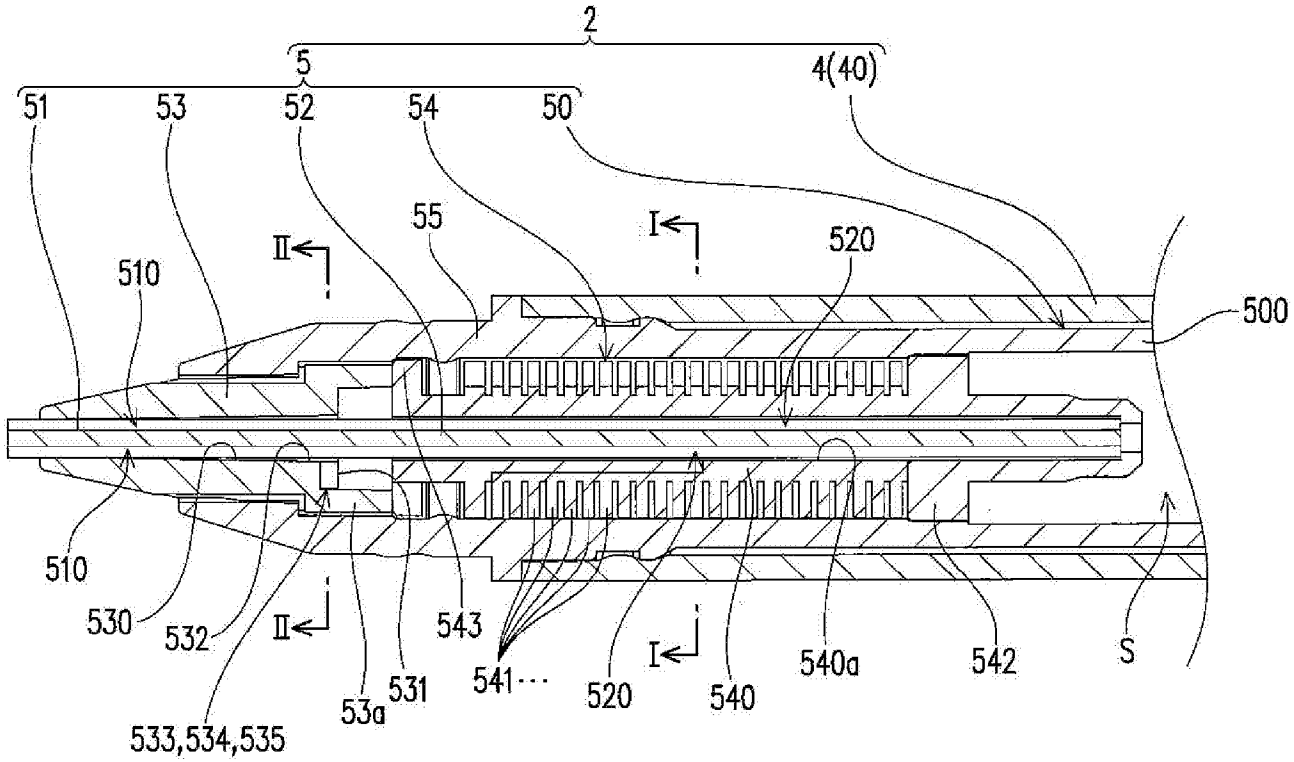
FIG. 3 is a partial enlarged sectional view of the pen (pen body) according to the aforementioned embodiment.

In this embodiment, the internal space S of the ink reservoir 50 is filled with a liquid ink containing decorative particles. Along with this, the refill 5 of this embodiment includes a collector 54 configured to adjust the amount of the ink to be supplied to the pen tip 51, as shown in FIG. 1 to FIG. 3.

The collector 54 is a so-called blade adjuster employed for writing tools of the direct liquid type such as a fountain pen. Specifically, the collector 54 includes a main shaft 540 having, along its center line, a through hole 540*a* through which the ink guide 52 is provided, and a plurality of partition blades 541 arranged at intervals in the axis direction of the main shaft 540 and extending from the outer surface of the main shaft 540. The collector 54 has flanges 542 and 543 extending radially outward at both ends of the main shaft 540, and the plurality of partition blades 541 are provided extending from the outer surface of the main shaft 540 between the two flanges 542 and 543.

Each of the plurality of partition blades 541 extends from substantially the entire perimeter of the main shaft 540 and is formed into a circular plate. Each interval between adjacent partition blades 541 is set so that the capillary force acts between the adjacent partition blades 541.

Figure 4:
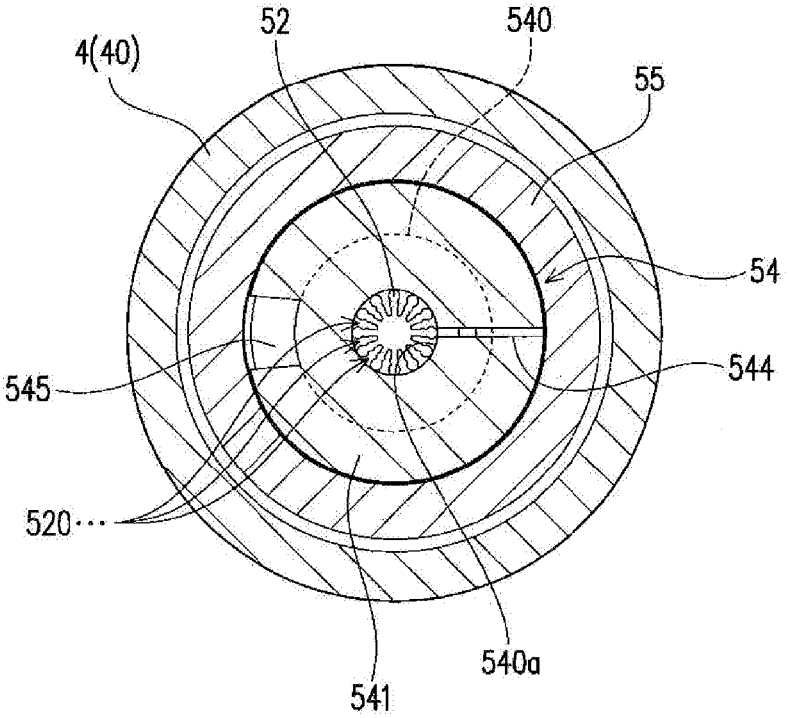
FIG. 4 is a sectional view taken along the line I-I of FIG. 3.

As shown in FIG. 4, a slit 544 extending in the extending direction of the partition blades 541 from the main shaft 540 is formed in each of the plurality of partition blades 541. The slits 544 of the partition blades 541 are formed to make a line in the axis direction of the main shaft 540. The slits 544 of the partition blades 541 open on the inner circumferential surface of the main shaft 540 that defines the through hole 540*a*. Further, in each of the plurality of partition blades 541, a cutout 545 for ventilation is provided at a position displaced from the slit 544 in the circumferential direction of the partition blades 541. The opening area of the cutout 545 as viewed in the axis direction of the main shaft 540 is set larger than that of the slit 544. The collector 54 configured as above is provided so that the flange 542 on one side closes the ink reservoir 50 (internal space S), as shown in FIG. 3.

More specifically, the refill 5 according to this embodiment includes a cylindrical holding part 55 which is formed continuously with the other end of the circumferential wall 500 that defines the internal space S of the ink reservoir 50 and which is configured to hold the collector 54 and the holder part 53 in the same line. Along with this, the collector 54 is fitted into the cylindrical holding part 55 with the flange 542 on one side located on the ink reservoir 50 side. Thereby, the flange 542 on one side of the collector 54 seals the internal space S of the ink reservoir 50 filled with the ink. Further, the cylindrical holding part 55 surrounds the plurality of partition blades 541 of the collector 54.

As shown in FIG. 1 to FIG. 3, the pen tip 51 has a proximal end to which the ink from the ink reservoir 50 is supplied, a distal end opposite to the proximal end and configured to contact the ink coating target, and a groove 510 opening on the outer circumferential surface and extending from the proximal end to the distal end.

More specifically, the pen tip 51 is formed into a rod shape. Along with this, the one end in the axial direction of the pen tip 51 serves as the proximal end supplied with the ink from the ink reservoir 50, and the other end in the axial direction of the pen tip 51 serves as the distal end configured to contact the ink coating target.

The pen tip 51 of this embodiment is molded into a rod shape having the groove 510 on the outer circumferential surface thereof by extrusion molding of a resin material (in this embodiment, a plastic).

The groove 510 of the pen tip 51 extends in the axial direction of the pen tip 51. The groove 510 of the pen tip 51 is formed over the total length in the axial direction of the pen tip 51. Along with this, the groove 510 of the pen tip 51 opens on the outer circumferential surface and opens also on one end face and the other end face in the axial direction of the pen tip 51.

Figure 5:
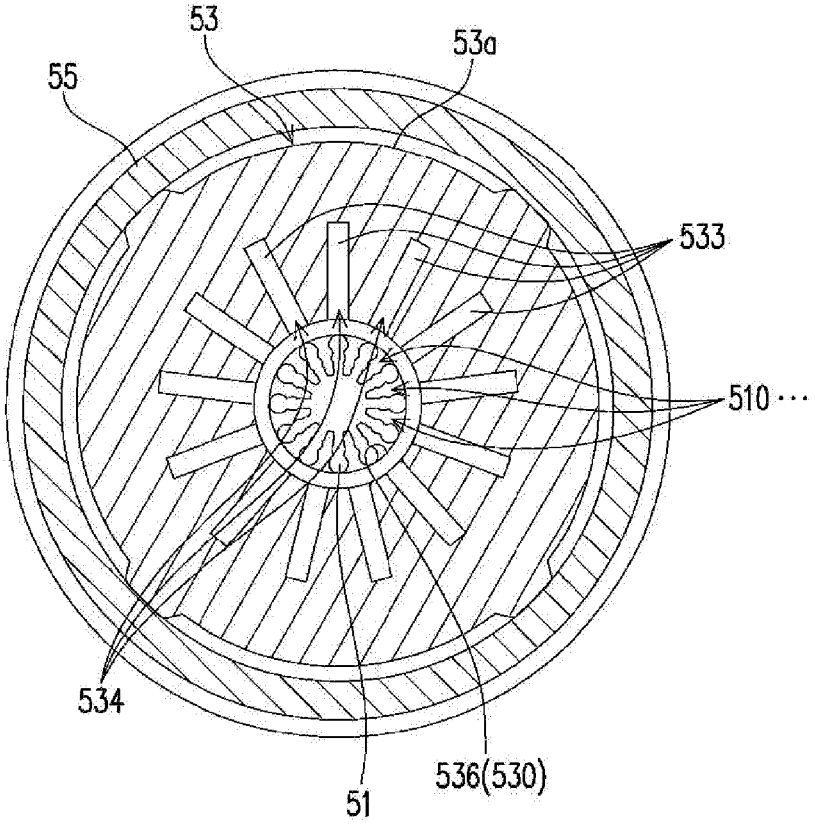
FIG. 5 is a sectional view taken along the line II-II of FIG. 3.

As shown in FIG. 5, the groove 510 of the pen tip 51 is enlarged from the center side toward the outer circumference of the pen tip 51.

The groove 510 of the pen tip 51 according to this embodiment has portions with an enlarged groove width and portions with a reduced groove width alternately from the center side toward the outer circumferential side. The groove 510 according to this embodiment is formed to have the largest width on the outer circumferential surface of the pen tip 51 by alternately arranging the portions with an enlarged groove width and the portions with a reduced groove width. That is, the groove 510 of the pen tip 51 is formed so as to be enlarged gradually from the center side toward the outer circumference and to be largest on the outer circumference of the pen tip 51.

In the pen tip 51 of this embodiment, a plurality of such grooves 510 are provided at intervals in the circumferential direction around the outer circumferential surface of the pen tip 51. The plurality of grooves 510 are arranged at equal intervals in the circumferential direction.

As shown in FIG. 1 to FIG. 3, the ink guide 52 according to this embodiment has one end connected to the ink reservoir 50, the other end opposite to the one end and connected to the pen tip 51, and a groove 520 opening on the outer circumferential surface and extending from the proximal end to the distal end.

More specifically, the ink guide 52 is formed into a rod shape with a length extending over the ink reservoir 50 (internal space S) and the pen tip 51. Along with this, the one end in the axial direction of the ink guide 52 is exposed into the ink reservoir 50, and the other end in the axial direction of the ink guide 52 is connected to the pen tip 51. As described above, since the pen 1 according to this embodiment includes the collector 54, the ink guide 52 is inserted through the through hole 540*a* of the collector 54 (the main shaft 540), the one end of the ink guide 52 is exposed to the internal space S of the ink reservoir 50, and the other end of the ink guide 52 is connected to the pen tip 51.

The ink guide 52 of this embodiment is molded into a rod shape having the groove 520 on the outer circumferential surface by extrusion molding of a resin material (in this embodiment, a plastic).

The groove 520 of the ink guide 52 extends in the axial direction of the ink guide 52. The groove 520 of the ink guide 52 is formed over the total length in the axial direction of the ink guide 52. Along with this, the groove 520 of the ink guide 52 opens on the outer circumferential surface and opens also on one end face and the other end face in the axial direction of the ink guide 52, as shown in FIG. 4.

The groove 520 of the ink guide 52 is enlarged from the center side toward the outer circumference of the ink guide 52.

The groove 520 of the ink guide 52 according to this embodiment has portions with an enlarged groove width and portions with a reduced groove width alternately from the center side toward the outer circumferential side. The groove 520 according to this embodiment is formed to have the largest width on the outer circumferential surface of the ink guide 52 by alternately arranging the portions with an enlarged groove width and the portions with a reduced groove width. That is, the groove 520 of the ink guide 52 is formed so as to be enlarged gradually from the center side toward the outer circumference and to be largest on the outer circumference of the ink guide 52.

In the ink guide 52 of this embodiment, a plurality of such groove 520 are provided at intervals in the circumferential direction around the outer circumferential surface of the ink guide 52. In this embodiment, the plurality of the grooves 520 are arranged at equal intervals in the circumferential direction.

In this embodiment, as shown in FIG. 1 to FIG. 3, the pen tip 51 and the ink guide 52 are molded integrally and continuously with each other. Further, the grooves 510 of the pen tip 51 and the grooves 520 of the ink guide 52 are continuous with each other.

In this embodiment, the pen tip 51 and the ink guide 52 are set to have the same sectional shape and the same cross sectional size (see FIG. 4 and FIG. 5), and the plurality of grooves 510 and 520 are linearly continuous with each other in the axis direction.

As described above, the holder part 53 has the through hole 530 through which the pen tip 51 is inserted, and the pen tip 51 is inserted through the through hole 530 with the distal end side extending to the outside.

The holder part 53 is formed into a cylindrical shape. The holder part 53 has a distal end face (not numbered) from which the distal end of the pen tip 51 extends and an annular surface 531 which is formed around the circumference of the through hole 530 and faces opposite to the distal end face of the holder part 53.

Figure 6:
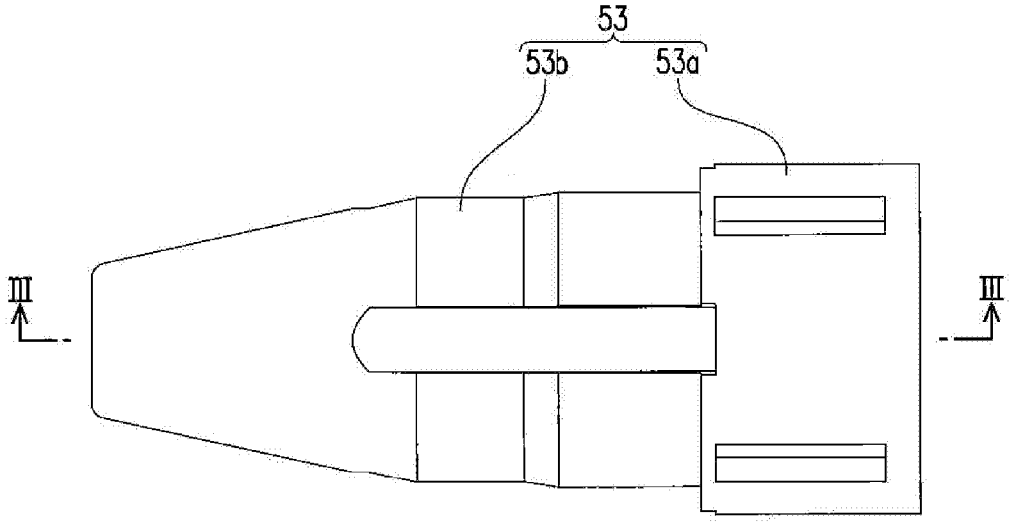
FIG. 6 is a plan view of a holder part in the pen according to the aforementioned embodiment.
Figure 7:
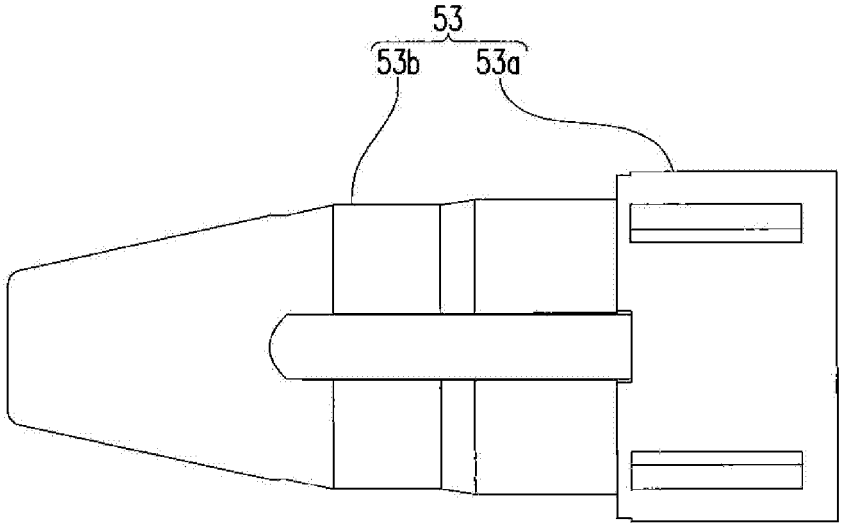
FIG. 7 is a front view of the holder part in the pen according to the aforementioned embodiment.
Figure 8:
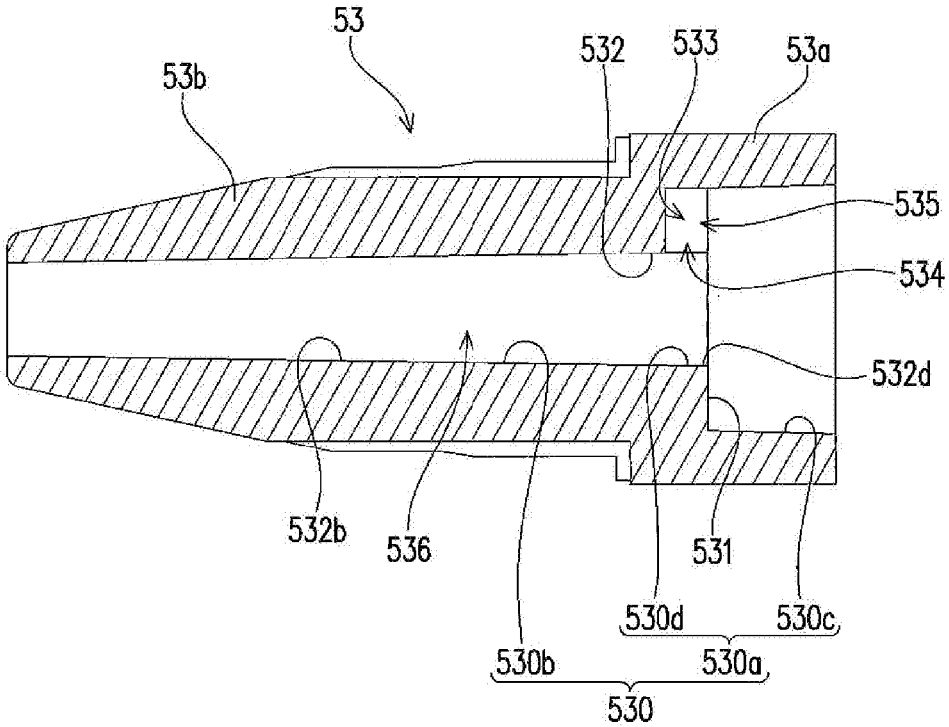
FIG. 8 is a sectional view taken along the line III-III of FIG. 6.

More specifically, as shown in FIG. 6 and FIG. 7, the holder part 53 includes a large diameter cylindrical part 53*a* located on the ink reservoir 50 side and a small diameter cylindrical part 53*b* which is formed to have a diameter smaller than the large diameter cylindrical part 53*a* and is continuous with the large diameter cylindrical part 53*a*. As shown in FIG. 8, an inner hole 530*a* of the large diameter cylindrical part 53*a* and an inner hole 530*b* of the small diameter cylindrical part 53*b* are continuous with each other in a concentric manner.

The inner hole 530*a* of the large diameter cylindrical part 53*a* is composed of a large diameter hole 530*c* set so that the other end of the ink guide 52 can be inserted therein, and a small diameter hole 530*d* which is continuous with the large diameter hole 530*c*, into which the pen tip 51 can be inserted, and which has a diameter smaller than the large diameter hole 530*c*. Thus, a step is formed in the holder part 53 (the large diameter cylindrical part 53*a*) due to the difference in diameter between the large diameter hole 530*c* and the small diameter hole 530*d*. Thus, the holder part 53 has, at the boundary between the large diameter hole 530*c* and the small diameter hole 530*d*, the annular surface 531 which is formed around the circumference of the through hole 530, is continuous with an inner circumferential surface 532 defining the through hole 530, and faces opposite to the distal end of the holder part 53.

The inner hole 530*b* of the small diameter cylindrical part 53*b* is formed concentrically with the inner hole 530*a* of the large diameter cylindrical part 53*a*. Further, the inner hole 530*b* of the small diameter cylindrical part 53*b* is set to have the same diameter as the small diameter hole 530*d* of the large diameter cylindrical part 53*a*, so that the pen tip 51 can be inserted therein.

Accordingly, the inner hole 530*a* of the large diameter cylindrical part 53*a* and the inner hole 530*b* of the small diameter cylindrical part 53*b* are continuous with each other, thereby forming the through hole 530 into which the pen tip 51 is inserted.

An inner circumferential surface 532*d* that defines the small diameter hole 530*d* of the large diameter cylindrical part 53*a* and an inner circumferential surface 532*b* of the inner hole 530*b* of the small diameter cylindrical part 53*b* form a continuous surface. That is, the small diameter hole 530*d* of the large diameter cylindrical part 53*a* and the inner hole 530*b* of the small diameter cylindrical part 53*b* constitute a continuous hole 536 through which the pen tip 51 can be inserted and which is defined by the inner circumferential surface 532 capable of at least partially binding the pen tip 51. In the following description, a portion of the through hole 530 formed by the small diameter hole 530*d* of the large diameter cylindrical part 53*a* and the inner hole 530*b* of the small diameter cylindrical part 53*b* will be referred to as the continuous hole 536 according to the aforementioned expression.

Figure 9:
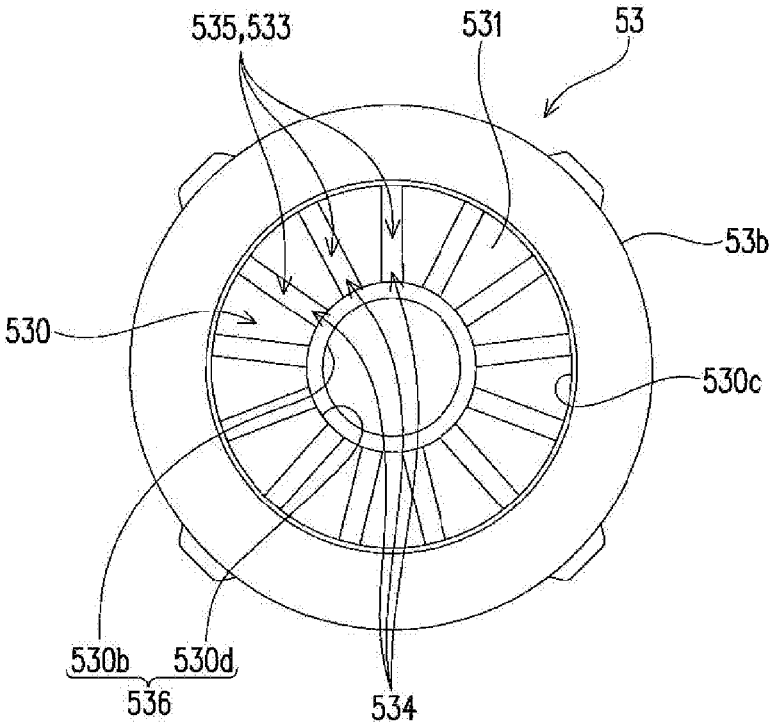
FIG. 9 is a side view of the holder part in the pen according to the aforementioned embodiment, as viewed from one side in the direction in which the center line of the holder part extends.
Figure 10:
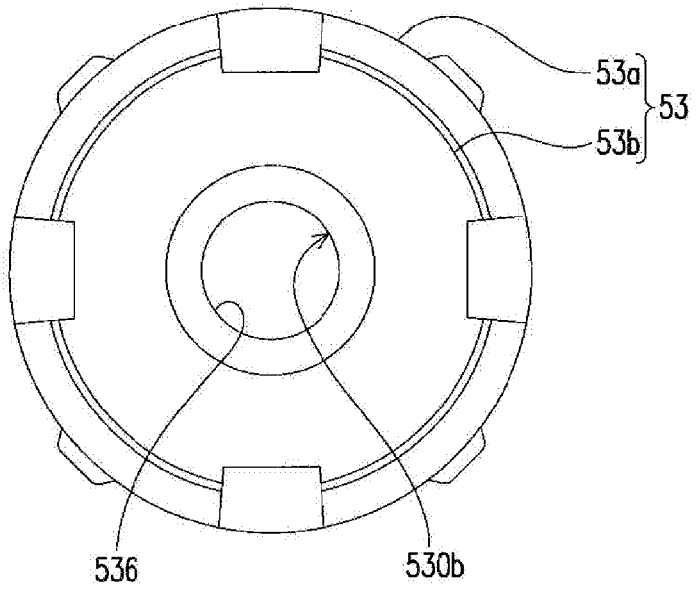
FIG. 10 is a side view of the holder part in the pen according to the aforementioned embodiment, as viewed from the other side in the direction in which the center line of the holder part extends.

The continuous hole 536 is formed according to the outer shape of the pen tip 51 to be held. In this embodiment, as shown in FIG. 9 and FIG. 10, the continuous hole 536 is formed into a circular shape as viewed in the extending direction of the center line of the continuous hole 536. In this embodiment, as shown in FIG. 8, the continuous hole 536 is formed as a tapered hole having a diameter decreasing from the large diameter cylindrical part 53*a* side toward the distal end face side of the holder part 53, so that the inner circumferential surface on the distal end side of the small diameter cylindrical part 53*b* holds the pen tip 51.

The holder part 53 according to this embodiment includes ink holding parts 533 capable of holding the ink from the ink guide 52 and formed at least partially around the circumference of the through hole 530, and first openings 534 opening on the inner circumferential surface 532 that defines the through hole 530 and communicating with the ink holding parts 533. A plurality of ink holding parts 533 are formed around the circumference of the through hole 530, and a plurality of first openings 534 are formed around the circumference of the through hole 530, corresponding to the plurality of ink holding parts 533. In this embodiment, the ink holding parts 533 and the first openings 534 are each formed into a slit shape (narrow gap shape).

In addition to the aforementioned configuration, the holder part 53 further includes the second openings 535 opening on the annular surface 531 and communicating with the ink holding parts 533. In this embodiment, the second openings 535 are formed into a slit shape (narrow gap shape).

Figure 11:
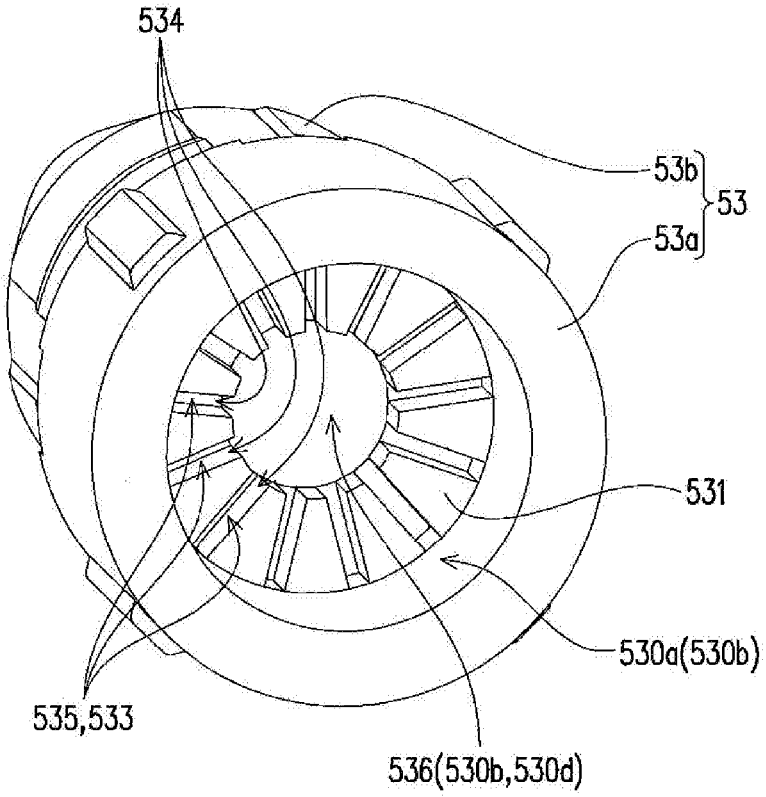
FIG. 11 is a perspective view of the holder part in the pen according to the aforementioned embodiment.

As shown in FIG. 5, FIG. 9, and FIG. 11, the ink holding parts 533 are provided around the circumference of the continuous hole 536 in the through hole 530. The ink holding parts 533 are formed into a slit shape extending in the same direction as the center line of the through hole 530 (the continuous hole 536). Here, the slit shape means to be formed like a narrow gap capable of exerting capillary force. In this embodiment, a plurality of ink holding parts 533 are provided around the circumference of the through hole 530 (the continuous hole 536). The ink holding parts 533 are formed into a slit shape extending in the same direction as the center line of the through hole 530 (the continuous hole 536) as described above, so that the plurality of ink holding parts 533 are radially arranged with the through hole 530 (the continuous hole 536) at the center.

As shown in FIG. 8, the ink holding parts 533 are formed within a specific range on the proximal end side of the holder part 53 in the direction of the center line of the through hole 530. Accordingly, the ink holding parts 533 are formed so as not to allow the circulation of the ink toward the distal end face side of the holder part 53 from which the pen tip 51 is exposed. That is, the ink holding parts 533 are formed so as to be capable of inhibiting the outflow of the ink toward the distal end side so that, when the ink adhering to the pen tip 51 is applied to the coating target, the inflowing ink is not supplied to the distal end of the pen tip 51 by being drawn to the distal end side of the pen tip 51.

As shown in FIG. 5, FIG. 9, and FIG. 11, the first openings 534 are provided around the circumference of the continuous hole 536 in the through hole 530 and open on the inner circumferential surface 532 that defines the through hole 530 (the continuous hole 536). The first openings 534 are formed into a slit shape extending in the same direction as the center line of the through hole 530 (the continuous hole 536). Here, the slit shape means to be formed like a narrow gap capable of exerting capillary force. In this embodiment, a plurality of first openings 534 are provided around the circumference of the through hole 530 (the continuous hole 536). In this embodiment, the plurality of first openings 534 are arranged corresponding respectively to the plurality of ink holding parts 533. That is, each of the plurality of first openings 534 is formed as a single slit together with its corresponding ink holding part 533. Accordingly, the plurality of first openings 534 are radially arranged with the through hole 530 (the continuous hole 536) at the center.

The first openings 534 are formed within a specific range on the proximal end side of the holder part 53 in the direction of the center line of the through hole 530. Accordingly, like the ink holding parts 533, the first openings 534 are formed so as not to allow the circulation of the ink toward the distal end face side of the holder part 53 from which the pen tip 51 is exposed. That is, the first openings 534 are formed so as to be capable of inhibiting the outflow of the ink toward the distal end face side of the holder part 53 so that, when the ink adhering to the pen tip 51 is applied to the coating target, the inflowing ink is not supplied to the distal end of the pen tip 51 by being drawn to the distal end side of the pen tip 51.

As shown in FIG. 9 and FIG. 11, the second openings 535 are provided around the circumference of the continuous hole 536 in the through hole 530 and open on the annular surface 531 formed at the boundary between the large diameter hole 530*c* and the small diameter hole 530*d*. The second openings 535 are formed into a slit shape extending in the radial direction of the through hole 530 (the continuous hole 536). Here, the slit shape means to be formed like a narrow gap capable of exerting capillary force. In this embodiment, a plurality of second openings 535 are provided around the circumference of the through hole 530 (the continuous hole 536). In this embodiment, the plurality of second openings 535 are arranged corresponding respectively to the plurality of ink holding parts 533. That is, each of the plurality of second openings 535 forms a single slit together with its corresponding ink holding part 533 and first opening 534. Accordingly, the plurality of second openings 535 are radially arranged with the through hole 530 (the continuous hole 536) at the center.

In this way, in the holder part 53 of this embodiment, the ink holding parts 533, the first openings 534, and the second openings 535 are arranged and formed corresponding to one another, so that the ink holding parts 533, the first openings 534, and the second openings 535 each form a single slit (gap) opening at two points on the inner circumferential surface 532 of the through hole 530 (the continuous hole 536) and the annular surface 531. In this embodiment, the first openings 534 and the second openings 535 open in different directions but continuously open at the connection point between the inner circumferential surface 532 of the through hole 530 (the continuous hole 536) and the annular surface 531.

Return to FIG. 3, the holder part 53 is fitted into the cylindrical holding part 55 with the large diameter cylindrical part 53*a* located on the ink reservoir 50 side. In such a state, the large diameter cylindrical part 53*a* is in tight contact with the flange 543 on the other side of the collector 54, thereby inhibiting leakage of the ink guided by the ink guide 52 to the outer circumference of the holder part 53. In this embodiment, while the small diameter cylindrical part 53*b* of the holder part 53 extends from the distal end of the cylindrical holding part 55, the distal end of the cylindrical holding part 55 and the distal end of the small diameter cylindrical part 53*b* of the holder part 53 are formed into a tapered cylinder together to constitute a substantially continuous tapered surface.

Further, the pen body 2 exposes the distal end of the cylindrical holding part 55, the distal end (the small diameter cylindrical part 53*b*) of the holder part 53, and the distal end of the pen tip 51 to the outside, while the refill 5 configured as above is fitted into the exterior body 4 (the barrel shaft 40). Thus, in this embodiment, the distal end of the cylindrical holding part 55 and the distal end (the small diameter cylindrical part 53*b*) of the holder part 53 of the pen body 2 (the refill 5) constitute a user's grip.

The pen 1 (the refill 5) according to this embodiment is configured as above. Next, the action thereof will be described.

In the pen 1 (the refill 5) configured as above, the ink in the ink reservoir 50 is guided by the ink guide 52. That is, the ink in the ink reservoir 50 circulates within the grooves 520 from the one end toward the other end of the ink guide 52 by capillary force of the grooves 520 of the ink guide 52. Then, the ink guided by the ink guide 52 is supplied, upon reaching the other end of the ink guide 52, from the other end of the ink guide 52 to the pen tip 51. Then, the ink supplied to the pen tip 51 circulates within the grooves 510 from the proximal end toward the distal end of the pen tip 51 by capillary force of the grooves 510 of the pen tip 51.

In the pen 1 according to this embodiment, the ink in the ink reservoir 50 contains decorative particles, but the grooves 520 formed in the ink guide 52 open on the outer circumference of the ink guide 52, and therefore the decorative particles are prevented from depositing on the ink guide 52 during the circulation of the ink within the grooves 520 of the ink guide 52, as described above.

That is, in the pen 1 according to this embodiment, the ink circulates within the grooves 520 opening on the outer circumference of the ink guide 52, and therefore the chance for the decorative particles contained in the ink to contact the wall surface that defines the circulation space (the grooves 520) can be reduced. As a result, the deposition on the ink guide 52 of the decorative particles contained in the ink is suppressed, and an appropriate circulation of the ink is ensured.

Further, the grooves 510 formed in the pen tip 51 open on the outer circumference of the pen tip 51, and therefore the decorative particles are prevented from depositing on the pen tip 51 during the circulation of the ink within the grooves 510 of the pen tip 51, as described above.

That is, in the pen 1 according to this embodiment, the ink circulates within the grooves 510 opening on the outer circumference of the pen tip 51, and therefore the chance for the decorative particles contained in the ink to contact the wall surface that defines the circulation space (the grooves 510) can be reduced. As a result, the deposition on the pen tip 51 of the decorative particles contained in the ink is suppressed, and an appropriate circulation of the ink is ensured.

In this embodiment, the ink guide 52 and the pen tip 51 are integrally molded, and the grooves 510 and 520 are continuous with each other, and therefore the ink supplied from the ink reservoir 50 circulates continuously from the one end of the ink guide 52 toward the distal end of the pen tip 51. However, in the case where the amount of the circulating ink is large, the collector 54 holds the excess ink circulating in the ink guide 52. Accordingly, an appropriate amount of the ink is supplied to the pen tip 51.

Further, in this embodiment, the holder part 53 includes the ink holding parts 533 provided around the through hole 530 (the continuous hole 536) through which the pen tip 51 is inserted, and the first openings 534 opening on the inner circumferential surface 532 that defines the through hole 530 and communicating with the ink holding parts 533. Therefore, when the grooves 510 around the outer circumference of the pen tip 51 are filled with the ink, the ink flows into the first openings 534, and the ink flows also into the ink holding parts 533 communicating with the first openings 534.

That is, the first openings 534 and the ink holding parts 533 communicating with the first openings 534 are formed into a slit shape, and therefore capillary force is generated therein. This causes an action of drawing the ink in the first openings 534 and the ink holding parts 533, and the ink in the grooves 510 opening on the outer circumferential surface of the pen tip 51 smoothly flows into the ink holding parts 533 via the first openings 534. Further, the second openings 535 communicating with the ink holding parts 533 are also formed into a slit shape, and therefore capillary force is generated in the second openings 535. This causes an action of drawing the ink in the second openings 535, and the ink in the ink holding parts 533 smoothly flows into the second openings 535. As a result, the ink holding parts 533, the first openings 534, and the second openings 535 are filled with the ink.

When the distal end of the pen tip 51 contacts the ink coating target, the ink on the pen tip 51 is consumed. Then, owing to the capillary force of the pen tip 51 and the ink guide 52, the ink in the ink reservoir 50 is supplied to the pen tip 51 through the aforementioned route. Accordingly, the pen 1 according to this embodiment can continuously apply the ink to the ink coating target.

As described above, the pen 1 (refill 5) according to this embodiment includes the ink reservoir 50 configured to store the ink containing decorative particles and the pen tip 51 configured to apply the ink to the ink coating target, wherein the pen tip 51 has the proximal end to which the ink from the ink reservoir 50 is supplied, the distal end opposite to the proximal end and configured to contact the ink coating target, and the grooves 510 opening on the outer circumferential surface and extending from the proximal end to the distal end.

In the pen 1 according to this embodiment, when the ink in the ink reservoir 50 is supplied to the pen tip 51, the ink flows into the grooves 510 formed around the outer circumference of the pen tip 51. Then, the supplied ink circulates from the proximal end toward the distal end of the pen tip 51 by capillary force of the grooves 510, and the distal end of the pen tip 51 is abundantly provided with the ink.

Then, when the distal end of the pen tip 51 contacts the ink coating target, the ink at the distal end of the pen tip 51 is transferred to the coating target, and the ink on the pen tip 51 is consumed. Along with this, the ink stored in the ink reservoir 50 is supplied to the pen tip 51. Accordingly, the pen 1 according to this embodiment can continuously apply the ink to the ink coating target.

Further, in the pen 1 (refill 5) according to this embodiment, the ink in the ink reservoir 50 contains the decorative particles, but the grooves 510 formed in the pen tip 51 open on the outer circumference of the pen tip 51, and therefore the decorative particles are prevented from depositing on the pen tip 51 following the circulation of the ink.

Specifically, when the circumference of the ink circulation space formed from the proximal end to the distal end of the pen tip 51 is closed, the chance for the decorative particles to be caught by or adhere to the wall surface that defines the circulation space increases, and therefore the decorative particles contained in the ink deposit, resulting in inhibition of the ink circulation.

However, in the pen 1 (refill 5) according to this embodiment, the ink circulates within the grooves 510 opening on the outer circumference of the pen tip 51, and therefore the chance for the decorative particles contained in the ink to contact the wall surface that defines the circulation space (the grooves 510) can be reduced. As a result, the deposition on the pen tip 51 of the decorative particles contained in the ink is suppressed, and an appropriate circulation of the ink is ensured.

Further, in this embodiment, the plurality of grooves 510 of the pen tip 51 are provided at intervals in the circumferential direction around the outer circumferential surface of the pen tip 51, and therefore the ink circulates in each of the plurality of grooves 510. Thereby, the ink is supplied at a plurality of points on the outer circumference at the distal end of the pen tip 51. Accordingly, regardless of the posture of the pen 1, the ink can be applied to the ink coating target by allowing the distal end of the pen tip 51 to contact the ink coating target.

Further, in this embodiment, the grooves 510 of the pen tip 51 are enlarged from the center side toward the outer circumference of the pen tip 51, and therefore the width of the grooves 510 increases toward the outer circumferential side of the pen tip 51. Thereby, even if comparatively large decorative particles are contained in the ink, the decorative particles pass through the wide regions of the grooves 510, and thus smooth circulation of the ink can be ensured.

The pen 1 (refill 5) according to this embodiment further includes the ink guide 52 configured to guide the ink in the ink reservoir 50 toward the pen tip 51, and the ink guide 52 has the one end connected to the ink reservoir 50, the other end opposite to the one end and connected to the pen tip 51, and the grooves 520 opening on the outer circumferential surface and extending from the one end to the other end.

Thereby, the pen 1 (refill 5) according to this embodiment can appropriately supply the ink containing decorative particles to the pen tip 51 from the ink reservoir 50.

Specifically, when the circumference of the ink circulation space formed from the one end to the other end of the ink guide 52 is closed, the chance for the decorative particles to be caught by or adhere to the wall surface that defines the circulation space increases, and therefore the decorative particles contained in the ink deposit, resulting in inhibition of the ink circulation.

However, in the pen 1 (refill 5) according to this embodiment, the ink circulates within the grooves 520 opening on the outer circumference of the ink guide 52, and therefore the chance for the decorative particles contained in the ink to contact the wall surface that defines the circulation space can be reduced. As a result, the deposition on the ink guide 52 of the decorative particles contained in the ink is suppressed, and an appropriate supply of the ink to the pen tip 51 is ensured.

Further, in the pen 1 (refill 5) according to this embodiment, the plurality of grooves 520 of the ink guide 52 are provided at intervals in the circumferential direction around the outer circumference of the ink guide 52, and therefore the ink circulates in each of the plurality of the grooves 520. Therefore, the ink is supplied at a plurality of points of the pen tip 51. Accordingly, the ink is reliably supplied to the pen tip 51.

Further, in the pen 1 (refill 5) according to this embodiment, the grooves 520 of the ink guide 52 are enlarged from the center side toward the outer circumference of the ink guide 52, and therefore the width of the grooves increases toward the outer circumferential side of the ink guide 52. Thereby, even if comparatively large decorative particles are contained in the ink, the decorative particles pass through the wide regions of the grooves, and thus smooth circulation of the ink can be ensured.

In particular, in the pen 1 (refill 5) according to this embodiment, the pen tip 51 and the ink guide 52 are molded integrally and continuously with each other, and the grooves 510 and 520 are continuous with each other. Therefore, the ink in the ink reservoir 50 circulates through the grooves 520 serving as ink guide bodies and subsequently circulates through the grooves 510 of the pen tip 51. That is, the circulation path of the ink is not intermittent, and smooth circulation of the ink is ensured.

The present invention is not limited to the aforementioned embodiment, and modifications can be appropriately made without departing from the gist of the present invention.

In the aforementioned embodiment, the pen 1 as a makeup kit used for cosmetics has been described, but there is no limitation to such a configuration. For example, the pen 1 may be, of course, a writing instrument (stationery) for writing.

In the aforementioned embodiment, the pen 1 in which the ink reservoir 50 of the pen refill 5 is provided inside the exterior body 4 (the barrel shaft 40), and the pen refill 5 is fixedly secured to the exterior body 4 (the barrel shaft 40) has been described, but there is no limitation to such a configuration. For example, the pen 1 may be configured so that the pen refill 5 is detachably (replaceably) attached to the exterior body 4 (the barrel shaft 40). That is, the pen refill 5 is not limited to the configuration of being fixedly secured to the exterior body 4 (the barrel shaft 40) and may have a configuration of being detachably attached to the exterior body 4 (the barrel shaft 40).

Further, the pen 1 is not limited to the configuration in which the pen refill 5 is attached to the exterior body 4 (the barrel shaft 40) and may be configured, for example, so that the exterior body 4 (the barrel shaft 40) forms the ink reservoir 50, and the ink guide 52, the holder part 53, and the pen tip 51 are attached to the exterior body 4 (the barrel shaft 40). That is, the pen refill 5 may serve as the pen 1 itself by adjusting the outer diameter and the size of the pen refill 5 to those suitable for writing.

In the aforementioned embodiment, the pen tip 51 and the ink guide 52 are integrally molded, but there is no limitation to such a configuration. In the case of providing the ink guide 52, the pen tip 51 and the ink guide 52 may be independent members being separated away from each other. In this case, the pen tip 51 and the ink guide 52 may have different sectional shapes and different cross sectional sizes from each other. That is, the shapes and sizes may be different between the grooves 510 of the pen tip 51 and the grooves 520 of the ink guide 52.

Also in this case, the configuration may be such that the other end of the ink guide 52 is connected to the proximal end of the pen tip 51, and the grooves 520 of the ink guide 52 and the grooves 510 of the pen tip 51 are continuous so as to allow the circulation of the ink.

In the aforementioned embodiment, the ink guide 52 is provided, but there is no limitation to such a configuration. For example, the ink reservoir 50 may be arranged adjacent to the pen tip 51 without providing the ink guide 52, so that the ink in the ink reservoir 50 is directly supplied to the pen tip 51.

In the aforementioned embodiment, the plurality of grooves 510 are provided in the pen tip 51, but there is no limitation to such a configuration. For example, one groove 510 may be provided in the pen tip 51. That is, the pen tip 51 needs only to have at least one groove 510. This applies also to the ink guide 52.

In the aforementioned embodiment, the grooves 510 of the pen tip 51 are enlarged from the center side toward the outer circumferential side of the pen tip 51, but there is no limitation to such a configuration. For example, the grooves 510 of the pen tip 51 may be formed to have the same width from the center side toward the outer circumferential surface side of the pen tip 51. This applies also to the ink guide 52.

In the aforementioned embodiment, the plurality of grooves 510 are provided in the pen tip 51, and the plurality of grooves 510 are arranged at equal intervals around the circumference of the pen tip 51 so as to be radially arranged as viewed in the center line direction of the pen tip 51, but there is no limitation to such a configuration. For example, the plurality of grooves 510 may be arranged at unequal intervals around the circumference of the pen tip 51. This applies also to the ink guide 52.

Figure 12:
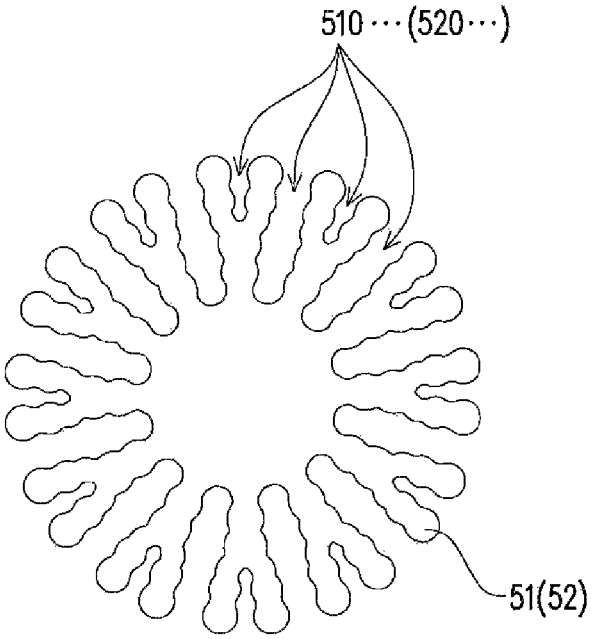
FIG. 12 is a sectional view of a pen tip or an ink guide of a pen (pen body) according to another embodiment of the present invention.

In the aforementioned embodiment, the plurality of grooves 510 provided in the pen tip 51 are set to have the same form and the same size, but there is no limitation to such a configuration. For example, in the case where the plurality of grooves 510 are provided in the pen tip 51, the grooves 510 having different forms and different sizes may be provided around the circumference, as shown in FIG. 12. This applies also to the ink guide 52.

In the aforementioned embodiment, the grooves 510 provided in the pen tip 51 are formed to extend straight from the center side toward the outer circumferential side of the pen tip 51, but there is no limitation to such a configuration. For example, the grooves 510 of the pen tip 51 may be formed to be tortuous from the center side toward the outer circumferential side of the pen tip 51. That is, the sectional shape of the grooves 510 of the pen tip 51 may be variously changed as long as they open on the outer circumference of the pen tip 51. However, for smooth circulation of the decorative particles contained in the ink, the formation is preferably such that the opening width on the outer circumferential surface of the pen tip 51 is larger than the groove width on the center side. This applies also to the ink guide 52.

Figure 13:
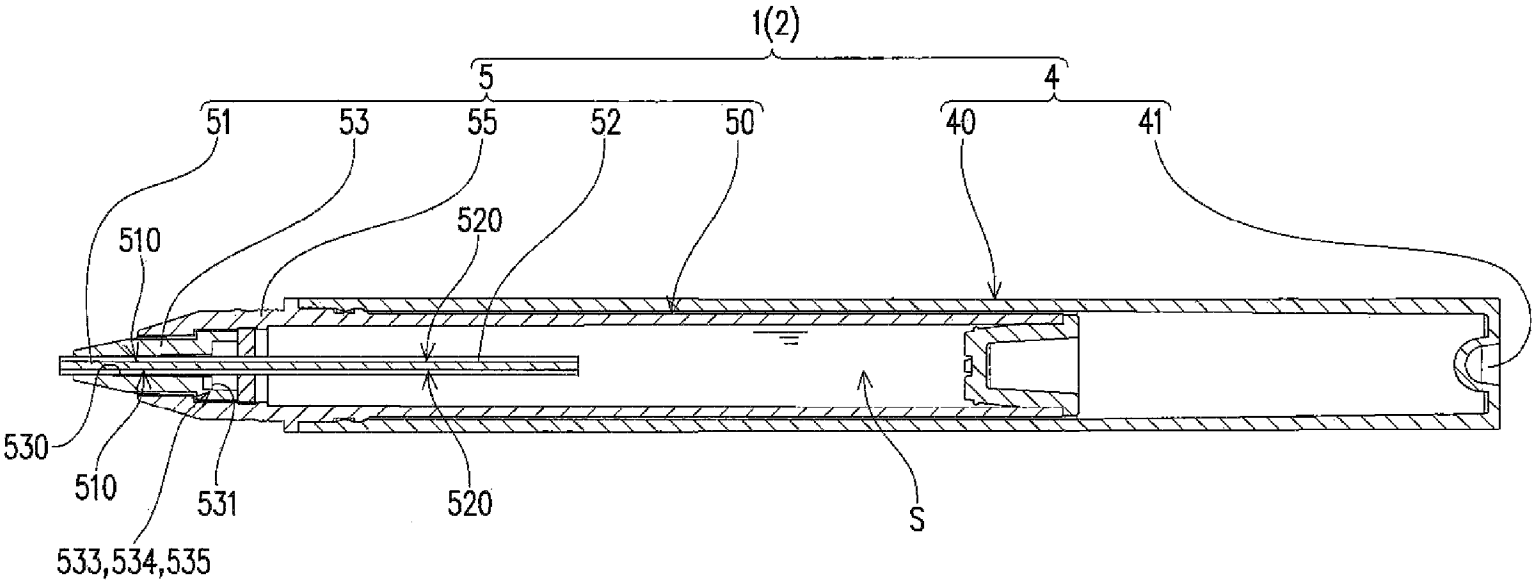
FIG. 13 is a sectional view of a pen (pen body) according to still another embodiment of the present invention.

In the aforementioned embodiment, the liquid ink is contained in the ink reservoir 50 formed into a tank shape as it is, and the collector 54 configured to adjust the supply amount of the ink from the ink reservoir 50 to the pen tip 51 is provided, but there is no limitation to such a configuration. For example, as shown in FIG. 13, the ink in the ink reservoir 50 may be supplied to the pen tip 51 simply using the ink guide 52 without providing the collector 54.

Figure 14:
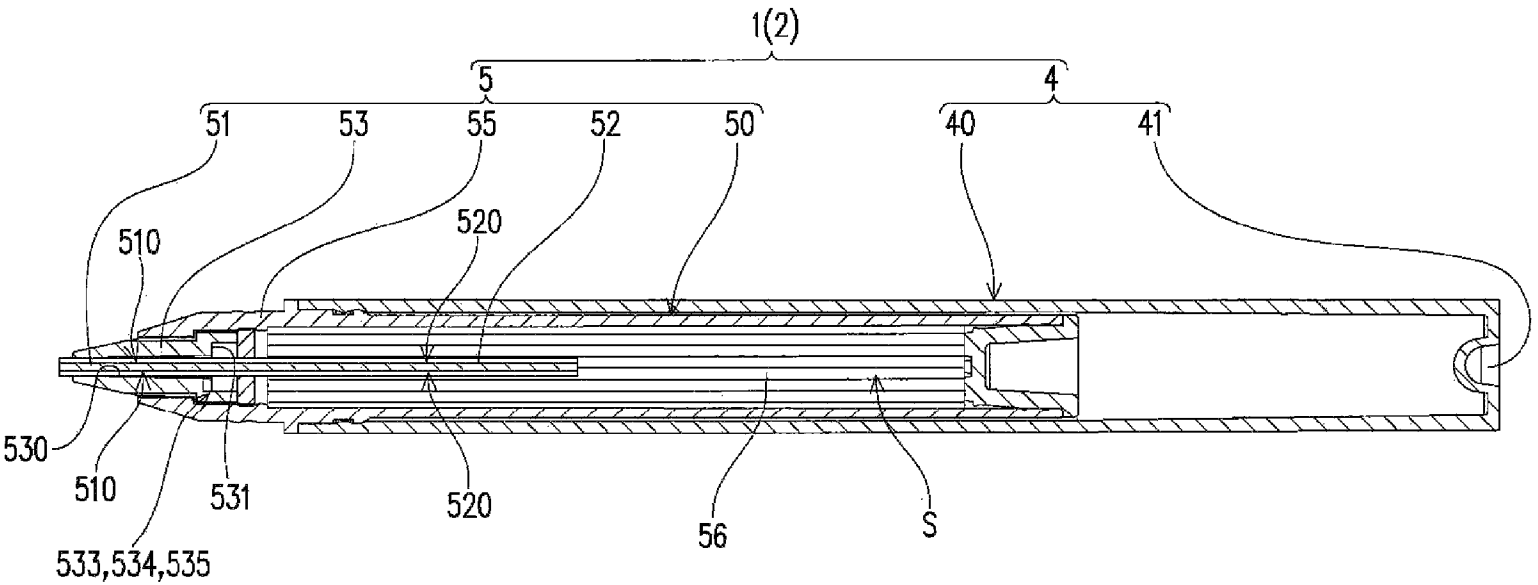
FIG. 14 is a sectional view of a pen (pen body) according to still another embodiment of the present invention.
Figure 15:
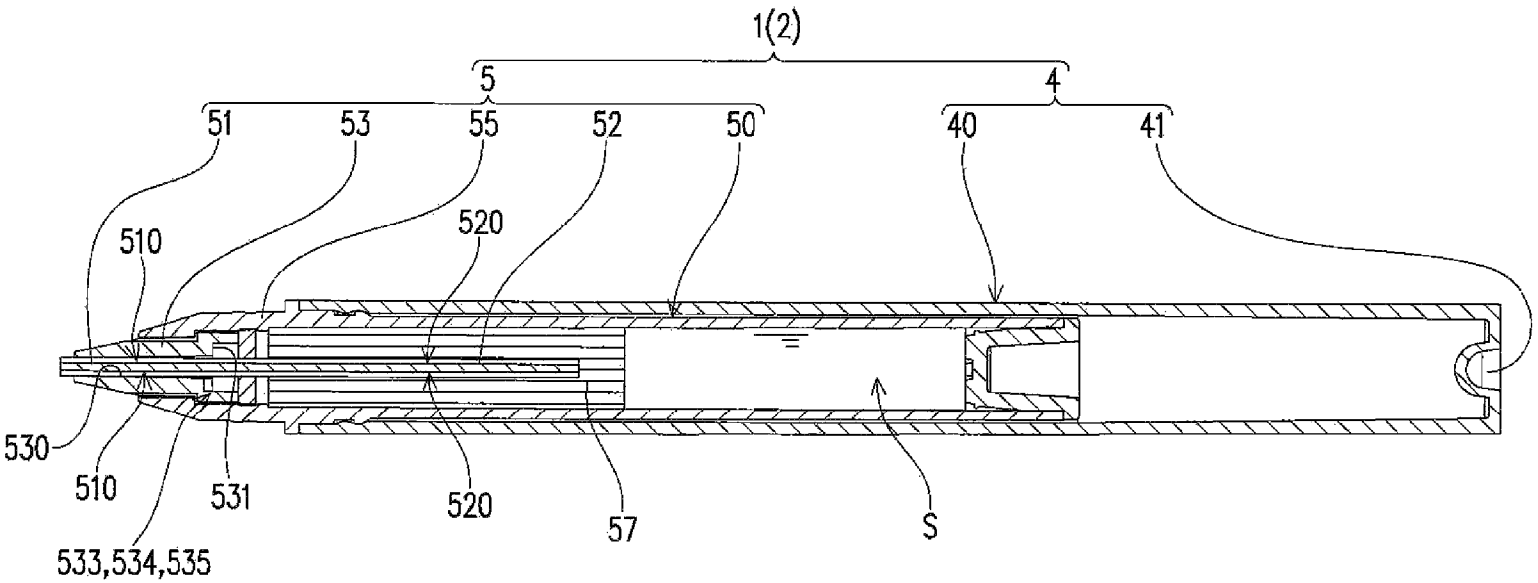
FIG. 15 is a sectional view of a pen (pen body) according to still another embodiment of the present invention.

Further, the ink reservoir 50 may be constituted by an ink absorbing member 56 with which the entire internal space S is filled and which has absorbed an ink, as shown in FIG. 14, or may be constituted by a specific region of the internal space S filled with a liquid ink and an ink absorbing member 57 which has liquid absorbability, with which the remaining region of the internal space S is filled, and which has absorbed the ink, as shown in FIG. 15. In the case of providing the ink absorbing members 56 and 57, the ink absorbing members 56 and 57 are, of course, configured so that the decorative particles contained in the ink do not stagnate.

In the aforementioned embodiment, the pen tip 51 is held by the holder part 53 including the ink holding parts 533, the first openings 534, and the second openings 535, but there is no limitation to such a configuration. For example, the holder part 53 may be provided with only the through hole 530 through which the pen tip 51 is inserted (without the ink holding parts 533, the first openings 534 and the second openings 535).

In the aforementioned embodiment, the holder part 53 includes the second openings 535, assuming that it includes the the ink holding parts 533, but there is no limitation to such a configuration. For example, in the case where the holder part 53 includes the the ink holding parts 533, the configuration may be such that the holder part 53 includes only the ink holding parts 533 and the first openings 534, as members for allowing the ink to flow therein or holding the ink, and the ink flows into and out of the ink holding parts 533 through the first openings 534. In this case, if the ink holding parts 533 are formed as closed spaces, the air or the ink remaining in the ink holding parts 533 tends to inhibit the inflow and outflow of the ink through the first openings 534, and therefore it is preferable to provide air passages (air passages configured to communicate the ink holding parts 533 with the outside) for allowing the ink holding parts 533 to be open spaces.

In the aforementioned embodiment, the ink holding parts 533 are formed into a slit shape extending in the same direction as the axial center of the through hole 530, but there is no limitation to such a configuration. For example, in the case where the holder part 53 includes the the ink holding parts 533, the ink holding parts 533 may be formed into a slit shape extending in the circumferential direction of the through hole 530. In this case, the ink holding parts 533 may be formed into an annular groove shape that forms an endless circle around the circumference of the through hole 530 or may be formed into a groove shape partially around the inner circumferential surface 532 that defines the through hole 530. Further, the ink holding parts 533 are not limited to those formed into a slit shape (groove shape), and may be simple hollows. Further, the ink holding parts 533 are not limited to the plurality of ink holding parts 533 formed around the circumference of the through hole 530 or those formed around the entire circumference of the through hole 530. For example, only one ink holding part 533 needs to be provided at at least one point around the circumference of the through hole 530.

In the aforementioned embodiment, the first openings 534 are formed into a slit shape extending in the same direction as the axial center of the through hole 530, corresponding to the ink holding parts 533, but there is no limitation to such a configuration. For example, in the case where the holder part 53 includes the the ink holding parts 533, the configuration may be such that the ink holding parts 533 are formed into a slit shape extending in the circumferential direction of the through hole 530, and the first openings 534 are formed into a slit shape extending along the ink holding parts 533. In this case, the first openings 534 may be formed to open continuously over the entire perimeter of the inner circumferential surface 532 or may be formed to open partially on the inner circumferential surface 532. Further, the first openings 534 are not limited to those corresponding to the form of the ink holding parts 533, and may be in a different form from the ink holding parts 533. That is, the form of the first openings 534 can be variously changed as long as they open on the inner circumferential surface 532 that is opposed to the pen tip 51 and communicate with the ink holding parts 533.

In the aforementioned embodiment, the second openings 535 are formed into a slit shape on the annular surface 531 corresponding to the ink holding parts 533, but there is no limitation to such a configuration. That is, in the case where the holder part 53 includes the ink holding parts 533, the form of the second openings 535 can be variously changed as long as they open on a surface (the annular surface 531) facing opposite to the distal end of the holder part 53 and communicate with the ink holding parts 533.

In the aforementioned embodiment, the first openings 534 and the second openings 535 continuously open at the connection point between the inner circumferential surface 532 of the through hole 530 (the continuous hole 536) and the annular surface 531, but there is no limitation to such a configuration. For example, in the case where the holder part 53 includes the first openings 534 and the second openings 535, the first openings 534 and the second openings 535 may be discontinuously formed as long as they communicate with the ink holding parts 533.

REFERENCE SIGNS LIST

1: Pen
2: Pen body
3: Cap
4: Exterior body
5: Refill (pen refill)
40: Barrel shaft
41: Tail
50: Ink reservoir
51: Pen tip
52: Ink guide
53: Holder part
53*a*: Large diameter cylindrical part
53*b*: Small diameter cylindrical part
54: Collector
55: Cylindrical holding part
56, 57: Ink absorbing member
500: Circumferential wall
501: Closure part
510: Groove
520: Groove
530: Through hole
530*a*: Inner hole
530*b*: Inner hole
530*c*: Large diameter hole
530*d*: Small diameter hole
531: Annular surface
532: Inner circumferential surface
532*b*: Inner circumferential surface
532*d*: Inner circumferential surface
533: Ink holding part
534: First opening
535: Second opening
536: Continuous hole
540: Main shaft
540*a*: Through hole
541: Partition blades
542, 543: Flange
544: Slit
545: Cutout
S: Internal space

The invention claimed is:

1. A pen comprising:

an ink reservoir configured to store an ink containing decorative particles;

a pen tip that has a proximal end to which the ink is supplied from the ink reservoir, a distal end opposite to the proximal end and configured to contact an ink coating target, and an outer circumferential surface extending from the proximal end to the distal end, and that is configured to apply the ink to the ink coating target; and a holder part having a through hole through which the pen tip is inserted, the holder part being configured to at least partially hold the pen tip while exposing the distal end of the pen tip in the state where the pen tip is inserted through the through hole, wherein the pen tip comprises a groove opening on the outer circumferential surface of the pen tip and extending from the proximal end to the distal end, and wherein the holder part comprises: a first opening on an inner circumferential surface that defines the through hole and is capable of at least partially binding the pen tip; and an ink holding part constituted by a hollow that communicates with the first opening, extends radially outward from the first opening, and is capable of holding the ink from the ink reservoir.

2. The pen according to claim 1, wherein a plurality of grooves of the pen tip are provided at intervals in a circumferential direction on the outer circumferential surface of the pen tip.

3. The pen according to claim 1, wherein the groove of the pen tip is enlarged from a center side toward the outer circumferential surface of the pen tip.

4. The pen according to claim 1, wherein the holder part comprises a distal end face from which the distal end of the pen tip extends and an annular surface which is formed around a circumference of the through hole and faces opposite to the distal end face of the holder part, and further comprises a second opening that opens on the annular surface and communicates with the ink holder part.

5. The pen according to claim 1, further comprising:

an ink guide configured to guide the ink in the ink reservoir toward the pen tip, wherein the ink guide comprises: a first end connected to the ink reservoir; a second end opposite to the first end and connected to the pen tip; and a groove opening on the outer circumferential surface of the ink guide and extending from the first end to the second end.

6. The pen according to claim 5, wherein a plurality of grooves of the ink guide are provided at intervals in a circumferential direction on the outer circumferential surface of the ink guide.

7. The pen according to claim 5, wherein the groove of the ink guide is enlarged from a center side toward the outer circumferential surface of the ink guide.

8. The pen according to claim 5, wherein the pen tip and the ink guide are molded integrally and continuously with each other, and the groove of the pen tip and the groove of the ink guide are formed continuously with each other.

9. A pen refill comprising:

an ink reservoir configured to store an ink containing decorative particles, the ink reservoir being housed in a barrel shaft constituting the exterior of a pen;

a pen tip that has a proximal end to which the ink is supplied from the ink reservoir, a distal end opposite to the proximal end and configured to contact an ink coating target, and an outer circumferential surface extending from the proximal end to the distal end, and that is configured to apply the ink to the ink coating target and configured to apply the ink to the ink coating target by being exposed from the barrel shaft; and a holder part having a through hole through which the pen tip is inserted, the holder part being configured to at least partially hold the pen tip while exposing the distal end of the pen tip in the state where the pen tip is inserted through the through hole, wherein the pen tip comprises a groove opening on the outer circumferential surface of the pen tip and extending from the proximal end to the distal end, and wherein the holder part comprises: a first opening on an inner circumferential surface that defines the through hole and is capable of at least partially binding the pen tip; and an ink holding part constituted by a hollow that communicates with the first opening, extends radially outward from the first opening, and is capable of holding the ink from the ink reservoir.

10. The pen refill according to claim 9, wherein a plurality of grooves of the pen tip are provided at intervals in a circumferential direction on the outer circumferential surface of the pen tip.

11. The pen refill according to claim 9, wherein the groove of the pen tip is enlarged from a center side toward the outer circumferential surface of the pen tip.

12. The pen refill according to claim 9, wherein the holder part comprises a distal end face from which the distal end of the pen tip extends and an annular surface which is formed around a circumference of the through hole and faces opposite to the distal end face of the holder part, and further comprises a second opening that opens on the annular surface and communicates with the ink holding part.

13. The pen refill according to claim 9, further comprising:

an ink guide configured to guide the ink in the ink reservoir toward the pen tip, wherein the ink guide comprises: a first end connected to the ink reservoir; a second end opposite to the first end and connected to the pen tip; and a groove opening on the outer circumferential surface of the ink guide and extending from the first end to the second end.

14. The pen refill according to claim 13, wherein a plurality of grooves of the ink guide are provided at intervals in a circumferential direction on the outer circumferential surface of the ink guide.

15. The pen refill according to claim 13, wherein the groove of the ink guide is enlarged from a center side toward the outer circumferential surface of the ink guide.

16. The pen refill according to claim 13, wherein the pen tip and the ink guide are molded integrally and continuously with each other, and the groove of the pen tip and the groove of the ink guide are formed continuously with each other.

* * * * *